United States Patent [19]

Kanbara et al.

[11] Patent Number: 4,834,345

[45] Date of Patent: May 30, 1989

[54] PROCESS AND APPARATUS FOR DIRECT SOFTENING HEAT TREATMENT OF ROLLED WIRE RODS

[75] Inventors: Susumu Kanbara; Kenji Aihara; Masato Tomiku; Yoshio Kawashima; Tadashi Sawada; Shinji Okuda; Mitsuaki Ikeda, all of Kitakyusyu, Japan

[73] Assignee: Sumitomo Metal Industries, Ltd., Osaka, Japan

[21] Appl. No.: 207,905

[22] Filed: Jun. 16, 1988

Related U.S. Application Data

[63] Continuation of Ser. No. 133,295, Dec. 15, 1987, abandoned, which is a continuation of Ser. No. 47,600, May 11, 1987, abandoned, which is a continuation of Ser. No. 728,218, Apr. 29, 1985, abandoned.

[30] Foreign Application Priority Data

| | | | |
|---|---|---|---|
| May 1, 1984 | [JP] | Japan | 59-89114 |
| Mar. 28, 1985 | [JP] | Japan | 60-65848 |
| Mar. 28, 1985 | [JP] | Japan | 60-65849 |
| Mar. 28, 1985 | [JP] | Japan | 60-46246 |
| Mar. 28, 1985 | [JP] | Japan | 60-46247 |
| Mar. 28, 1985 | [JP] | Japan | 60-46248 |
| Mar. 28, 1985 | [JP] | Japan | 60-46249 |

[51] Int. Cl.[4] ..... C21D 9/54; C21D 9/56; B21B 45/00

[52] U.S. Cl. ..... 266/105; 72/202; 266/262; 266/277; 148/12 B

[58] Field of Search ..... 72/128, 200, 202; 148/12 B; 242/79, 82, 83; 266/105, 106, 252, 262, 263, 277; 432/59, 260

[56] References Cited

U.S. PATENT DOCUMENTS

| | | | |
|---|---|---|---|
| 1,152,848 | 9/1915 | Schliggemann | 242/79 |
| 3,135,477 | 6/1964 | Brown | 242/83 X |
| 3,750,974 | 8/1973 | Dibrell | 242/82 X |
| 3,778,221 | 12/1973 | Bloom | 432/260 X |
| 3,820,372 | 6/1974 | Cutton | 72/203 |
| 4,170,494 | 10/1979 | Fujii et al. | 148/12 B |
| 4,242,153 | 12/1980 | Vitelli et al. | 266/106 X |
| 4,360,390 | 11/1982 | Tominaga et al. | 148/12 B |
| 4,401,481 | 8/1983 | Gilvar et al. | 148/12 B |
| 4,406,618 | 9/1983 | Maeyama | 266/252 X |
| 4,415,145 | 11/1983 | Herdieckerhoff | 266/252 X |
| 4,604,145 | 8/1986 | Kanabara et al. | 148/12 B |

FOREIGN PATENT DOCUMENTS

| | | | |
|---|---|---|---|
| 1527695 | 1/1970 | Fed. Rep. of Germany . | |
| 2261878 | 6/1973 | Fed. Rep. of Germany . | |
| 595059 | 9/1925 | France . | |
| 659703 | 7/1929 | France . | |
| 52-80214 | 5/1977 | Japan | 148/12 B |
| 289878 | 8/1928 | United Kingdom . | |
| 309176 | 3/1930 | United Kingdom . | |
| 511279 | 8/1939 | United Kingdom . | |

*Primary Examiner*—E. Michael Combs

*Attorney, Agent, or Firm*—Burns, Doane, Swecker & Mathis

[57] ABSTRACT

Direct softening heat treatment of rolled wire rods comprises the steps:

providing wire rods by hot- or warm-rolling, and immediately following rolling, coiling the rolled wire rods in an annealing furnace. Apparatus therefor comprises an annealing furnace provided with an externally or internally built coiler for rolled wire rods disposed adjacent to a rolling line of said wire rods, the coiler being disposed so as to directly receive the rolled wire rods.

26 Claims, 8 Drawing Sheets

PROCESS AND APPARATUS FOR DIRECT SOFTENING HEAT TREATMENT OF ROLLED WIRE RODS

This application is a continuation of application Ser. No. 133,295, filed Dec. 15, 1987, abandoned which is a continuation of application Ser. No. 047,600, filed May 11, 1987, abandoned which is a continuation of application Ser. No. 728,218, filed Apr. 29, 1985, abandoned.

FIELD OF THE INVENTION

The present invention relates to a process and apparatus for direct softening heat treatment, wherein wire rods are formed by hot- or warm-rolling, and are immediately thereafter softened by annealing, e.g., heat holding or gradual cooling, making use of the sensible heat of the wire rods after rolling.

BACKGROUND OF THE DISCLOSURE

In most cases, various steel wire rods are subjected to softening heat treatments such as softening or spheroidizing annealing to decrease the hardness thereof. In such heat treatments as carried out heretofore, the wire rods produced in the rolling step are placed in the coil form in a heat treatment furnace disposed as a separate line where they are heated from normal temperature to 600°–800° C., followed by gradual cooling or heat holding. However, the rate of temperature rise of the wire rod is extremely low in the coiled form, and they should be held for an extended period of time so as to decrease a temperature difference or variation in the outer and inner portions of the coil, and gradually cooled. Occasionally, a prolonged time period of as long as 20 hours or longer may be required for such treatments.

For that reason, it has been proposed in e.g., Japanese Patent Kokai-Publication No. 58-107426 to rapidly heat wire rods in a stranded state and, thereafter, coil up them in a heat-holding furnace with a view of curtailing the treating time. However, such a proposal has the disadvantage that, due to the use of high-frequency heating as the rapid heating means, the consumption of electric powder is so increased that it is costly, although the treating time is curtailed. This proposal poses also another problem that the coiled wire rod easily suffers surface flaws during the transportation from the rolling line to the coiling line after the rolling step.

To this end, direct softening heat treatment processes for softening wire rods by gradually cooling or heat holding them just after rolling, making use of the sensible heat thereof after hot- or warm-rolling, have been proposed in Japanese Patent KoKai-Publication Nos. 56-133445, 58-27926, 58-58235, 58-107416, 59-13024, etc. All these processes involve softening wire rods by a combination of the rolling conditions with the gradual cooling conditions after rolling. Among others, Japanese Patent Kokai-Publication No. 56-133445 teaches that, as illustrated in FIG. 5, once a wire rod M has been wound around a coiler device 1 disposed outside of a gradual cooling furnace 2 after rolling, the obtained coil M' is placed in the cooling furnace. In this process, however, there are considerable variations in the quality of coils after the softening heat treatment, which are attributable on the one hand to temperature variations in the axial direction of the coils based on a difference in the air cooling time from the initiation to the completion of coiling and on the other hand to temperature differences in the radial direction of the coils based on the heat radiation from the surface of the coils. This is because the coils should previously be coiled up outside of the gradual cooling furnace. Furthermore, in a warm-rolling process, e.g., that is finished just at a temperature above the point of $Ar_1$ transformation, there is a disadvantage that the later gradual cooling only produces a significantly decreased softening effect since $Ar_1$ transformation is completed during coiling-up.

SUMMARY OF THE DISCLOSURE

It is an object of the present invention to provide a novel process and apparatus which can effectively obviate the aforesaid problems of the prior art processes for direct-softening heat treatment of wire rods. Namely, it is a particular object of the present invention to eliminate variations in the quality of coils due to temperature variations in the axial and radial directions thereof and a lowering of the softening effect in the warm-rolling as occur in the conventional processes and apparatuses for direct softening heat treatment after hot- or warm-rolling for obtaining wire rod coils of stable quality.

More specifically, the present invention provides a process wherein coiling of wire rods is immediately after rolling effected in an annealing furnace to eliminate temperature variations in the axial and radial directions of coils.

The apparatus for carrying out this process is characterized in that an annealing furnace having internally built-in or externally attached coiler-means for wire rods is disposed immediately adjacent to a rolling line of the wire rods. The annealing furnace embraces a heat-holding furnace or a gradual cooling furnace.

In the present disclosure, the wording "gradual cooling" means that cooling is effected at a cooling rate of no higher than 2° C./sec, and the wording "heat-holding" means keeping the rolled wire rods at a substantially same temperature level for a predetermined period of time, thus may be called "hot or warm holding", too. The wording "coiling" means that a wire rod is formed to a coil either with or without aid of guiding means such as reel, posts, cone or core, or the like.

According to the process of the present invention, since the wire rods are present in the annealing furnace all the time from the start through the completion of the coiling, there is no possibility that any difference in the air cooling time from the start to the completion of the coiling may occur. In consequence, uniformity of the temperature distribution in the axial direction of the coils is achieved, and any temperature variations in the radial direction of the coils based on the heat radiation from the surface of the coils are eliminated. Besides, even in warm-rolling that is finished at a temperature just above the point of $Ar_1$ transformation, the process of the present invention provides products of very stable quality, since the $Ar_1$ transformation takes place in the annealing furnace.

In the present invention, either the laying type coiler device of the upright or horizontal type or the pouring type coiler device may be used as the coiling means that is built inside or outside the annealing furnace. If possible, it is desired that the coiling device be equipped with a stirrer to achieve uniform distribution of temperatures within the furnace, since the temperature distribution may become uneven in the axial and radial direction of the coils, even while they are being coiled. In a preferred embodiment, a rotating laying cone is provided with blade or vane means at the lower portion thereof, wherein it is important that the blade or vane means do not interfere with wire rods guide out of a laying pipe. Such an arrangement allows the blade or vane means to rotate in operative association with the rotation of the laying cone with no need of using any special power means, whereby the air prevailing within the furnace is agitated to make the temperature distribution in the resultant coils uniform.

In a further preferred embodiment, wire rods guided out of the laying pipe are guided onto a pre-heated rider with the use of guide means. The guide means may be constructed of a guide rod which is descendable between the laying cone and a rider-holding mechanism in operative association with descending of the rider-holding mechanism, and is ascendable individually. The rider-holding mechanism ascends or descends to hold the rider at the lower position of the laying cone. The presence of such a guide rod makes a contribution to coiling and stability of the resultant coils during the coiling. Furthermore, a temporary holding mechanism may be interposed between the laying cone and the rider-holding mechanism for temporary supporting of wire rods. In this case, if the rider is carried on a delivery roller, continuous treatment is then made possible.

In order to effectively carry out the present invention, the heat-holding furnace may be tightly partitioned into a wire rod coiling portion and a heat-holding portion by means of an openable door member. Such an arrangement makes it possible to maintain the temperature control of the heat-holding portion and the state of the prevailing atmosphere to high accuracy. In addition, by tightly sub-partitioning the heat-holding portion into a plurality of sub-holding portions by means of openable doors, it is possible to establish heat patterns which correspond to the respective sub-holding portions.

While the aforesaid heat-holding furnace may be a continuously operated furnace, pot furnaces (i.e., those operated in a batch system) may be used as well in the present invention. The pot furnaces are prepared by the required number corresponding to the number of rolled coils. Upon completion of charging of the coils, the pot furnaces are successively delivered on a conveyor. The use of the pot furnaces makes it possible to heat-treat the coils separately.

According to the process and apparatus of the present invention, since as-rolled wire rods can be subjected to direct-softening heat treatment, it is possible to uniformly and sufficiently soften the coils in their entirety. Besides, it is feasible to produce wire rod coils of more stable quality even in the direct-softening heat treatment after warm-rolling, wherein the quality of the resultant product often becomes unstable. Furthermore, there is a great advantage in view of energy saving, since use is effectively made of the sensible heat of the rolled wire rods.

BRIEF DESCRIPTION OF THE DRAWINGS

The foregoing and other objects and features of the present invention will become apparent from the following detailed description with reference to the accompanying drawings, which are given for the purpose of illustration alone, and in which.

DETAILED DESCRIPTION OF THE PREFERRED EMBODIMENTS

Figure 1:
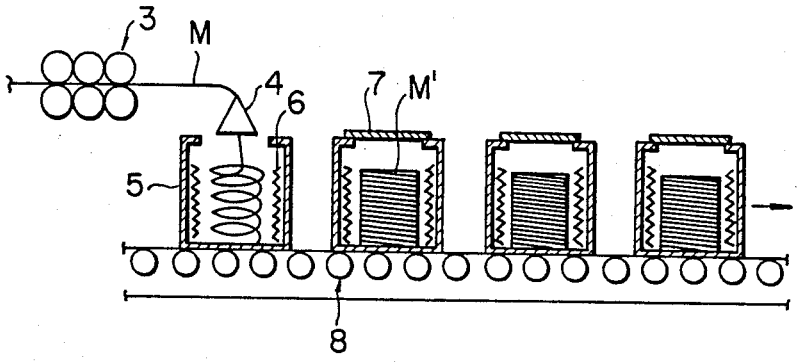
FIGS. 1 to 3 are schematical views showing the direct-softening heat treatment apparatus for carrying out the process of the present invention.

FIG. 1 illustrates a process for heat-treating a wire rod M in a pot furnace 5, said wire rod being hot- or warm-rolled in a roll mill 3. The wire rod M leaving the roll mill 3 is spirally formed by a laying head or cone 4, and is immediately coiled within the pot furnace 5 adjacent to the laying head 4. The pot furnace is previously heated to the desired temperature by means of a built-in heat generator 6. Immediately after the wire rod M has completely been taken up into a coil M' within the pot furnace 5, that furnace is closed up by means of a furnace lid 7. The required number of pot furnaces are prepared corresponding to the number of rolled coils, and are successively delivered onto a conveyor 8 upon completion of coil charging.

The coil charged in the pot furnace 5 is subjected to the desired annealing, e.g., gradual cooling or heat-holding during delivery, and at the point of time at which the given temperature or time is reached, the furnace lid 7 is removed to take out the coils for completion of direct-softening heat treatment. The emptied pot furnace is immediately supplied through a separate line, and is again heated to the desired temperature in the vicinity of the laying head 4 for direct-softening heat treatment.

Figure 2:
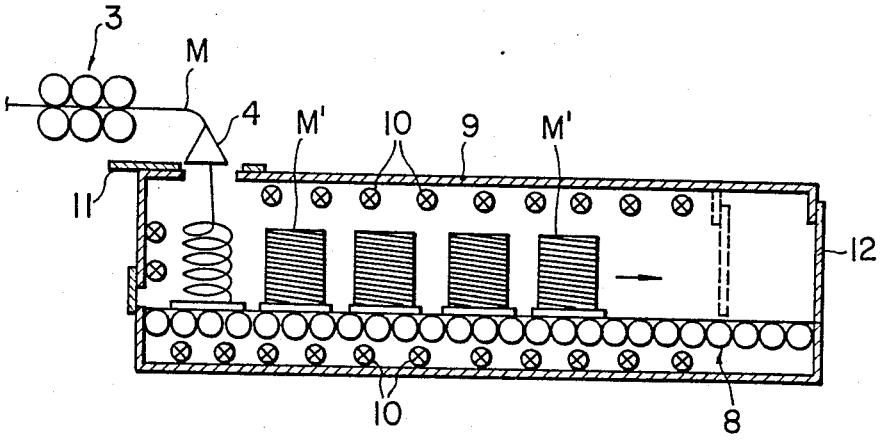

FIG. 2 illustrates a process for direct-softening heat treatment in a continuously operated furnace (continuous furnace) 9. A wire rod M is hot- or warm-rolled by a roll mill 3, and is thereafter spirally formed by a laying head 4, immediately followed by coiling in the continuous furnace 9. As is the case with the aforesaid pot furnace, the continuous furnace 9 also includes a built-in heat generator 10. However, it further includes therethrough a conveyor 8 and on the discharge side a door 12 for discharging the coils.

While the wire rod M leaving the rolling mill 3 is spirally formed by the laying head 4, it is coiled within the continuous furnace 9 previously maintained at the desired temperature or to a heat pattern of gradual cooling. Immediately after it has completely been taken up into a coil, a furnace lid 11 is closed to close the furnace until the initiation of subsequent coil charging. While a succession of coils M' are delivered on the conveyor 8 passing through the furnace, they are subjected to annealing, e.g., heat-holding or gradual cooling. The coils heat-treated in the predetermined manner are discharged from the discharge port by opening the door 12 for completion of direct-softening heat treatment.

It is to be understood that it is desired that the aforesaid pot or continuous furnace is provided with inert or reducing gas-sealing means so as to prevent oxidation and decarburization phenomena from growing on the surface layer of the wire rods during the heat treatment. In the continuous furnace, therefore, it is preferred to provide a double door, as indicated by a dotted line, so as to keep the internal atmosphere of the furnace from being disturbed upon discharging the treated coils.

Figure 3:
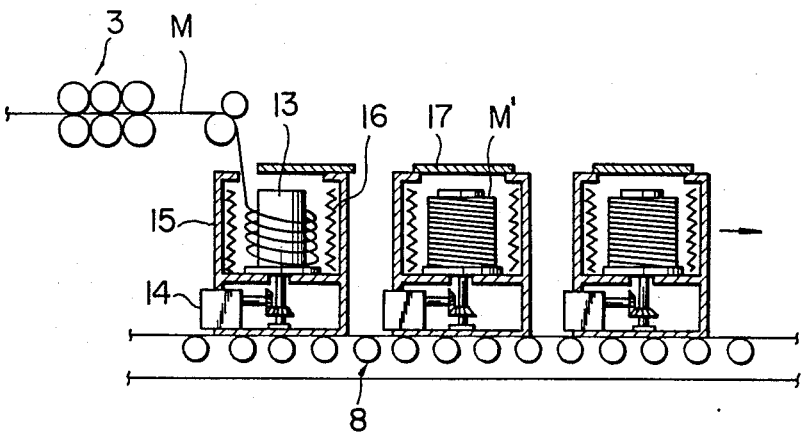

In FIGS. 1 and 2, the laying heads are typically used as the coiler means. However, a take-up reel 13 driven by a motor 14 may be used in a pot furnace 15 with a built-in heat generator 16, as shown in FIG. 3. In this system, immediately after a wire rod M has been rolled by a roll mill 3, it is placed within the pot furnace 15, and is rolled up around the motor-driven take-up reel 13. Completely taken up into coils M', a furnace lid 17 is closed to successively deliver them on a conveyor 8.

While the foregoing embodiments have been described using the built-in heat generator as the heating or heat-holding means, it is to be understood that heat sources are not necessarily located within the furnaces. Any suitable heat sources may be located outside of the furnaces. For instance, high-temperature gases may be blown into the furnace from the outside. In addition, any heat sources are not always required, if the desired annealing (heat holding or gradual cooling) can be carried out.

In what follows, the examples of the present invention will be given.

EXAMPLE 1

Figure 4:
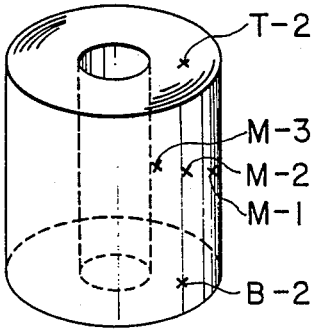
FIG. 4 is a view illustrative the portion in the inventive embodiment, out of which a sample is taken.
Figure 12:
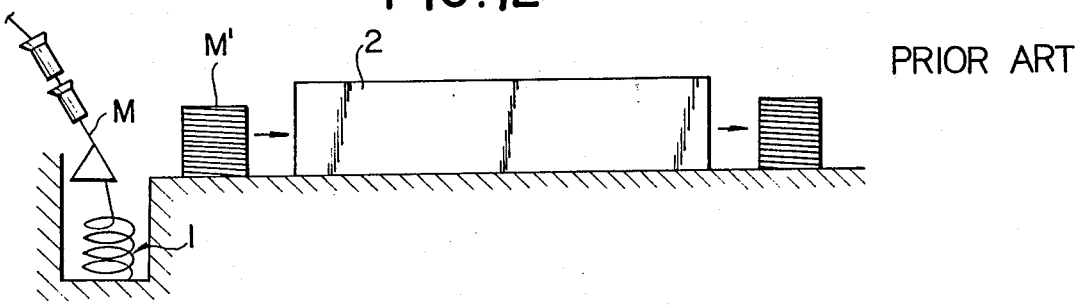
FIG. 12 is a schematical view showing one embodiment of the conventional direct-softening heat treatment process.

Three 2-ton billets for each of S45 C and SCM435, 180 mm × 180 mm in section, were prepared. They were soaked to 1100° C., and were hot-rolled in such a manner that the final rod diameter was 11 mm and the finish rolling temperature was 950° C. Out of three wire rods, one wire rod was taken up into a coil outside of the continuous furnace, and was thereafter subjected to the conventional process (FIG. 12) wherein it was placed into the gradual-cooling furnace (continuous furnace). The remaining wire rods were taken up in a continuous furnace or pot furnaces into coils, and the coils were gradually cooled as such, according to the process of the present invention. According to the heat pattern of gradual cooling then applied, the furnace was maintained at a temperature of 750° C. during charging of the coils, and at a temperature of 650° C. during discharging thereof effected one hour after charging. As illustrated in FIG. 4, samples were taken out of the portions of the treated coils which were located on the axially intermediate level and the radially outer, middle and inner portions (M-1, M-2, M-3) as well as located on the radially intermediate, axially upper and lower portions (T-2, B-2) for the purpose of tensile strength testing. The results are shown in Table 1.

TABLE 1

| | Type of Steel | Gradual Cooling Furnace | Tensile Strength (kgf/mm²) | | | | | Drawing Ratio (%) | | | | |
|---|---|---|---|---|---|---|---|---|---|---|---|---|
| | | | T-2 | M-1 | M-2 | M-3 | B-2 | T-2 | M-1 | M-2 | M-3 | B-2 |
| Prior Art Process | S45C | Continuous Furnace | 58 | 63 | 59 | 58 | 68 | 51 | 53 | 50 | 55 | 48 |
| | SCM435 | Continuous Furnace | 56 | 75 | 56 | 59 | 77 | 61 | 48 | 64 | 58 | 45 |
| Invented Process | S45C | Pot Furnace | 57 | 58 | 56 | 57 | 57 | 53 | 55 | 55 | 52 | 55 |
| | | Continuous Furnace | 58 | 57 | 56 | 57 | 56 | 52 | 54 | 55 | 53 | 54 |
| | SCM435 | Pot Furnace | 56 | 57 | 57 | 57 | 59 | 65 | 63 | 65 | 63 | 62 |
| | | Continuous Furnace | 58 | 59 | 56 | 58 | 56 | 64 | 63 | 66 | 62 | 66 |

EXAMPLE 2

Billets having the same dimensions as in Example 1 were after a soaking at a temperature of 950° C. rolled at a finish rolling temperature of 700° C. Apart from the heat pattern of gradual cooling in which the furnace was maintained at a temperature of 700° C. in charging of the coils, and at a temperature of 650° C. in discharging thereof, which took place 30 minutes after charging, the conditions applied for direct-softening heat treatment were the same as in Example 1. Table 2 shows the results of tensile strength testing of the heat-treated samples.

TABLE 2

| | Type of Steel | Gradual Cooling Furnace | Tensile Strength (kgf/mm²) | | | | | Drawing Ratio (%) | | | | |
|---|---|---|---|---|---|---|---|---|---|---|---|---|
| | | | T-2 | M-1 | M-2 | M-3 | B-2 | T-2 | M-1 | M-2 | M-3 | B-2 |
| Prior Art Process | S45C | Continuous Furnace | 55 | 69 | 54 | 55 | 70 | 60 | 50 | 59 | 58 | 48 |
| | SCM435 | Continuous Furnace | 55 | 92 | 54 | 61 | 90 | 65 | 42 | 63 | 56 | 45 |
| Invented Process | S45C | Pot Furnace | 54 | 53 | 54 | 55 | 54 | 60 | 62 | 59 | 60 | 59 |
| | | Continuous Furnace | 53 | 55 | 54 | 55 | 55 | 63 | 60 | 62 | 59 | 60 |
| | SCM435 | Pot Furnace | 54 | 55 | 55 | 56 | 55 | 67 | 68 | 66 | 69 | 67 |
| | | Continuous Furnace | 56 | 54 | 55 | 56 | 54 | 68 | 71 | 69 | 68 | 70 |

As will be evident from the results of Tables 1 and 2, the coils obtained by the prior art process are not sufficiently softened at the lower and outer regions, so that there is a very large variation in the quality of the coils. This is due to the fact that the lower portions of the coils are allowed to stand for a longer perod of time outside of the furnace, and the peripheral portion of the coils are exposed to the open air, whereby the rate of cooling is so increased that $Ar_1$ transformation is completed prior to charging of the coils into the gradual cooling furnace.

According to the process of the present invention, on the other hand, the products of very stable quality are obtained, since $Ar_1$ transformation takes place within the furnace.

Although the foregoing explanation has directed to the simplest structure based on the basic principle of the present invention, the coiler device and the annealing furnace (heat-holding furnace or gradual cooling furnace) may be of the structures to be described later so as to carry out more effectively the present invention.

Figure 5:
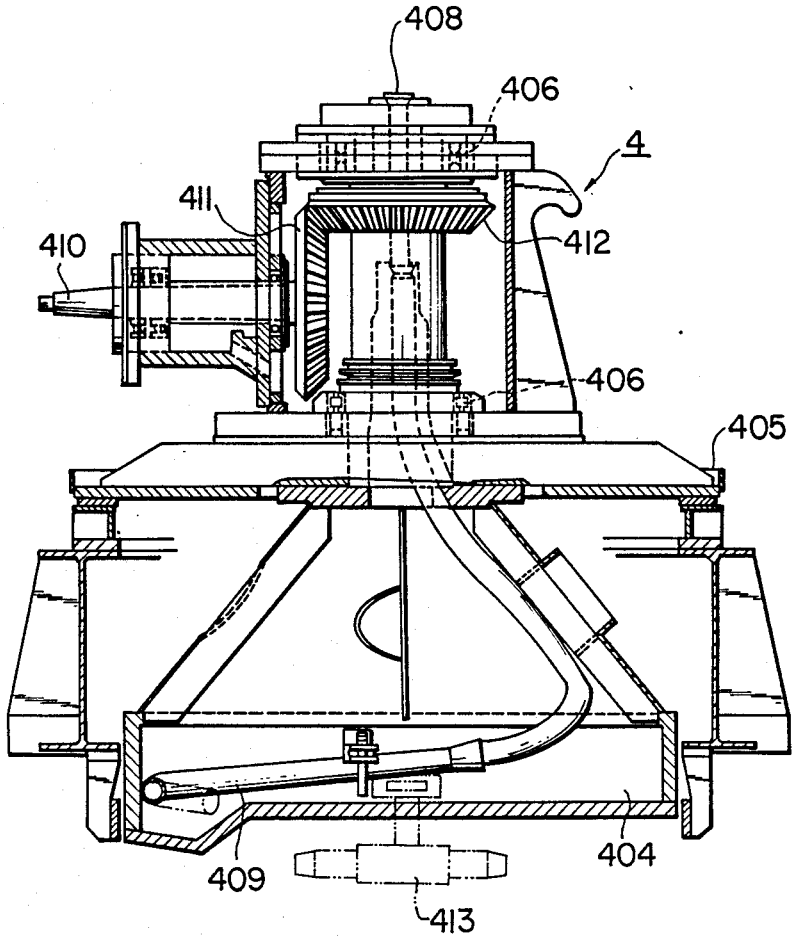
FIGS. 5 to 9 illustrate the coiler means used in carrying out the present invention, FIG. 5 being a sectional view of the laying cone, FIG. 6 being a sectional view showing the hot coil guide means, FIG. 7 being a sectional view taken along the line VII—VII of FIG. 6, FIG. 8 being a sectional view showing the pouring type coiler device, and FIG. 9 being a sectional view taken along the line IX—IX of FIG. 8, FIGS. 10 and 11 are sectional views showing the structure of the heat-holding furnace.

As illustrated in FIG. 5, the laying cone may be provided with blade or vane means fixed at the lower portion thereof so as to achieve uniform distribution of temperatures of the coiler means.

In this drawing, reference numeral 4 stands for a laying cone mounted to a ceiling wall 403 of the aforesaid heat-holding furnace 9. That cone 4 is tightly attached to the ceiling wall 403 by means of, for instance, gas sealing. A rotary cone 404 is rotatably supported by a base 405 through a bearing 406, and includes therein an entry pipe 408 for guiding a wire rod M and a laying pipe 409 for inducing the wire rod M in a spiral fashion. Through a shaft 410 and bevel gears 411 and 412, the rotation of a motor is transmitted to the rotary cone 404 having therein the entry pipe 404 and laying pipe 409, whereby the given rotation is given thereto.

A blade or vane 413 is fixedly provided at the central portion of the lower position of the rotary cone 404 and at a position where it does not interfere with the wire rod M guided out of the laying pipe 409, and rotates in operative association with the rotation of the rotary cone 404 to agitate the in-furnace atmosphere, so that the atmosphere temperature in the wire rod coiler portion is made uniform.

Since the revolutions per minute of the laying cone 4 vary depending upon the diameter of the wire rod M, there occurs a change in the revolutions per minute of the blade 413, viz., a change in the amount of air to be blown, in association with a variation in those revolutions per minute. Where this change in the amount of air poses a problem, suitable design modifications such as use of a variable pitch type blade, etc. may be made to cope with it. It is to be noted that some portions of the laying cone 2 which are exposed to the high-temperature atmosphere within the furnace, that is, the lower portion of the rotary cone 4 and the blade 413, are formed of a heat-resistant material capable of resisting to such an atmosphere.

Figure 6:
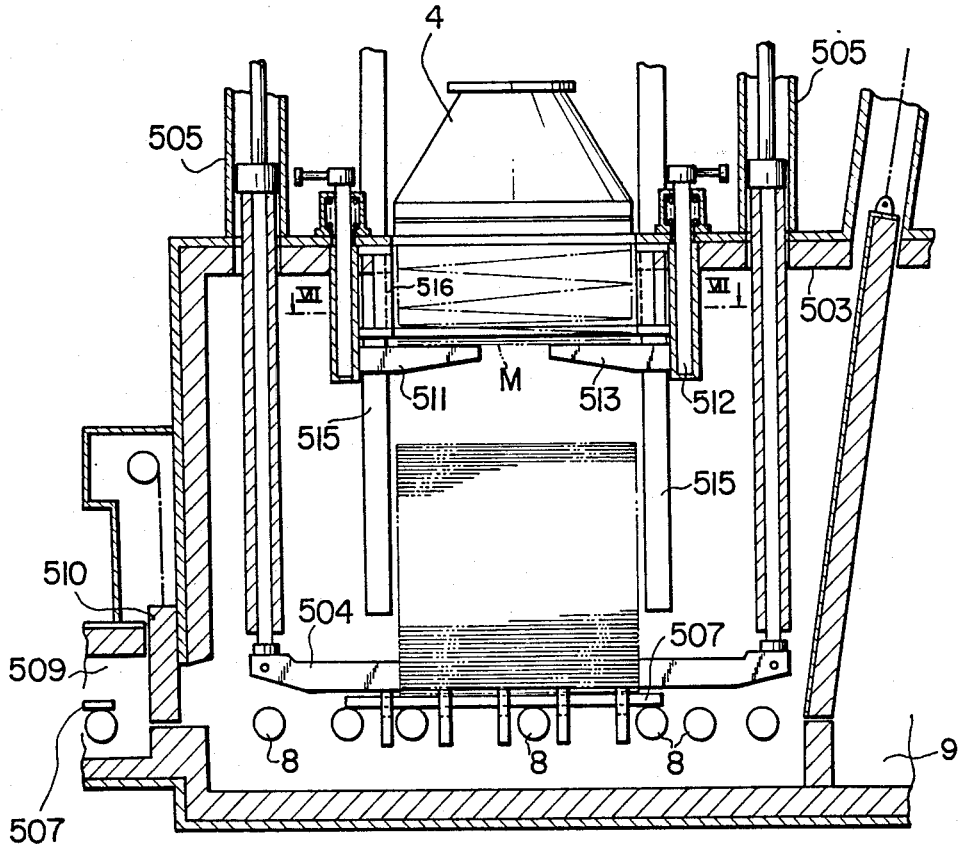

Referring to FIG. 6, a rider-holding mechanism 504 is provided for supporting a rider to be described later, and is located at a lower position of the laying cone 4 in the furnace. That mechanism 504 is in the form of a drainboard, and is of the structure that, when it is caused to ascend or descend within the furnace by means of, for instance, four ascending/desceding cylinder devices 505, it does not interfere with delivery rollers 8 located at the lower portion in the furnace, and it is positioned below the delivery roller 8 at its lower most position. It goes without saying that the intervals of the cylinder devices 505 are larger than the width of the rider.

A rider 507 is supported on the rider-holding mechanism 504 to receive a wire rod M guided out of the laying cone 4. After the rider 507 has been pre-heated to the given temperature in a rider pre-heating furnace 509 which is successively provided at the inlet end of a heat-holding furnace 9, it is carried into the heat-holding furnace 9 on the rollers, as occasion demands. It is to be noted that a door 510 for insertion of the rider is interposed between the heat-holding furnace 9 and the rider pre-heating furance 509, and is designed to is be lifted up or down by means of a winch, if required, whereby the pre-heated rider 507 can be carried into the heat-holding furnace 9.

Figure 7:
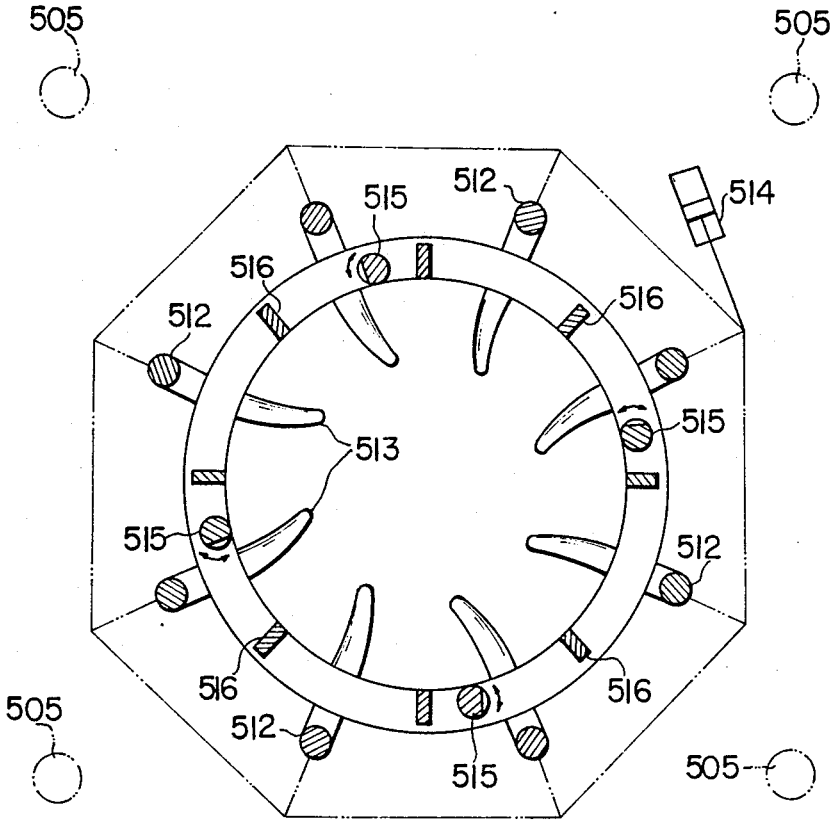

A temporary supporting-mechanism 511 for the wire rod M is interposed between the laying cone 4 and the rider-holding mechanism 504 in the furnace, and is designed such that, after the required amount of the wire rod M has been coiled, while allowing the rider-holding mechanism 504 to descend, for delivery into the heat-holding furnace 9, it temporarily holds that wire rod M until it receives the next rider 509 and ascends to receive the next wire rod M. The temporary supporting mechanism 511 is of the structure that includes a plurality of shafts 512 depending from the same circumference and supporting plates 513 attached to the lower ends thereof. By rotating the shafts 512 in unison, supporting and release of the wire rod M are effected. It is to be noted that numeral reference 514 (FIG. 7) stands for a cylinder device for rotation of the shafts 512.

A hot coil guide device is attached to a coiler device mounted in the heat-holding furnace as mentioned in the foregoing with a view to forming and stabilizing the coiled wire rod M. That coil guide device is of the following structure.

A suitable number (four in this embodiment) of guide rods 515 depend from the same circumference that has a given diameter and is coaxial with respect to the laying cone 4, and are movable upwardly in the furnace by means of an air cylinder device (not illustrated) which is to be mounted on the ceiling wall 503 of the heat-holding furnace, or are rotatable through the required angle by means of a rotary mechanism (not shown). It is to be understood that, in this embodiment, the guide rods 515 will be described as being descendable by their own weight; however, ascending and descending movement of the guide rods may be effected by an air cylinder device. It is to be understood that the sectional shape of the guide rod 515 is not limited to a round shape that is partly cut out, and a guide rod of a round shape may be mounted in an eccentric manner.

Upper fixed guides 516 are fixedly provided on the same circumference as that for the guide rods 515 for the purpose of controlling the outer diameter of coils during coiling in between the laying cone 4 and the temporary supporting mechanism 511. It is noted, however, that the upper fixed guides 516 are not indispensable, and serves only to help the guide rods 515.

It is to be understood that, since the installations as described in the foregoing operates in a hot-state, they are all formed of a heat-resistant material, or subjected to a heat-resistant treatment such as application of a heat-resistant material over the surface thereof.

Next, the guide device of this embodiment operates in the following order.

(1) The wire rod M guided along the laying cone 4 falls in the heat-holding furnace, while its outer diameter is controlled by the guide rods 515 and the upper fixed guides 516. At this time, the rider-holding mechanism 504 supporting the pre-heated rider 517 is positioned at a certain interval with respect to the lyaing cone 4, and descends depending upon the height of the coil M'.

(2) In operative association with descending of the rider-holding mechanism 504, the guide rods 515 descend, and prevent the coil M' from coming down sideways, while controlling the outer diameter thereof.

(3) Upon completion of coiling of the coil M', the rider-holding mechanism 504 descends to the lowermost position. On the other hand, the guide rods 515 are allowed to descend to a position where they do not interfere with the delivery of the coil M'.

(4) Subsequent to completion of delivery of the coil M', a new rider 507 is inserted, and the rider-holding mechanism 504 now supporting said rider 507 ascends to a stand-by position.

The foregoing operations are repeatedly effected.

Figure 8:
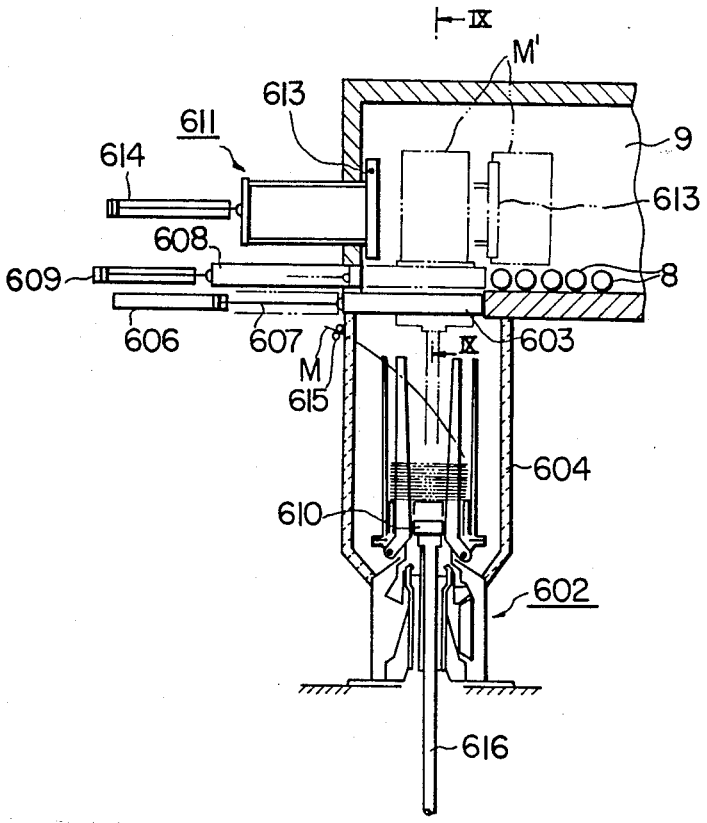

In the present invention, use may be made of not only the aforesaid laying type coiler but also the pouring type coiler, as illustrated in FIG. 8 as another embodiment.

A pouring type coiler or reel 602 is disposed below a bottom wall 603 of the heat holding furnace 9, is surrounded with an insulating material, and is designed to coil a wire rod M in the same atmosphere as that prevailing in the furnace.

A cylinder device 606 includes a piston rod attached at the free end to a part of the bottom wall 603 of the furnace. Reciprocation of the piston rod 607 causes the bottom wall 603 to slide, thereby inserting a coil M' taken up by the coiler 602 into the furnace.

Figure 9:
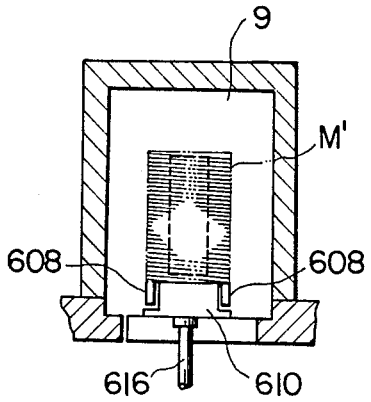

A coil finger 608 is arranged just above and in parallel with the part of the bottom wall 603, and is also designed to slide by a cylinder device 609, like the bottom wall 603 does. For instance, the coil finger 608 takes on the U-shaped form, and is designed to support the coil M' on a coil plate 610 of the coiler 602 without interfering with that plate 610 (see FIG. 9).

A pusher mechanism 611 is to push onto delivery rollers 8 in the furnace the coil M' carried from the coil plate 610 to the coil finger 608, and is comprised of a coil pusher 613 disposed in th furnace and a cylinder device 614 for reciprocation of said coil pusher 613. The coil pusher 613 is formed into a concave plane corresponding to the outer surface of the coil M' for the purpose of preventing the coil from being marred on the outer surface.

It is to be noted that reference numeral 615 stands for a pinch roll for guiding the wire rod M after finish-rolling to the pouring type coiler 602, and reference numeral 616 indicates a stripper shaft for ascending and descending movement of the coil plate 610. In this embodiment, the members disposed within the furnace, for instance, the coil finger 608 and the coil pusher 613 are formed of a heat-resistant material, since they are operated in a hot-state. In the instant embodiment, it is understood that guide members are provided for guiding sliding of the bottom wall 603, the coil finger 608, etc., although not illustrated, and these sliding mechanisms are not limited to the cylinder devices.

The foregoing treating system operates in the following order.

(1) The finish-rolled wire rod M is fed to the pouring type coiler 602 through the pinch roll 615 to form the coil M'.

(2) Subsequent actuation of the cylinder device 606 causes the bottom wall 603 to slide in the left-hand direction in FIG. 8. The coil M' on the coil plate 610 is then pushed upwardly under the action of the stripper shaft 616.

(3) Thereafter, actuation of the cylinder device 609 causes the coil finger 608 to slide in the right-hand direction in FIG. 8. Then, the coil plate 610 is lowered to the original position under the action of the stripper shaft 616. By these operations, the coil M' is carried from the coil plate 610 to the coil finger 608, and the pouring type coiler 602 is provided for the next coiling.

(4) Subsequently, the cylinder device 606 is actuated to slide the bottom wall 603 to the original position. The coil M' supported by the coil finger 608 is pushed onto the delivery roller 8 by the coil pusher 613 through the actuation of the cylinder device 614. The speed for pushing the coil M' by the coil pusher 613 is then synchronized with the delivery speed thereof on the delivery rollers 612.

(5) After carrying of the coil onto the delivery rollers 612 has been completed, the coil pusher 613 and the coil finger 608 are moved to the original positions by the associated cylinder devices 614 and 609, and stands ready for the following operation.

The foregoing operations are repeatedly effected.

Figure 10:
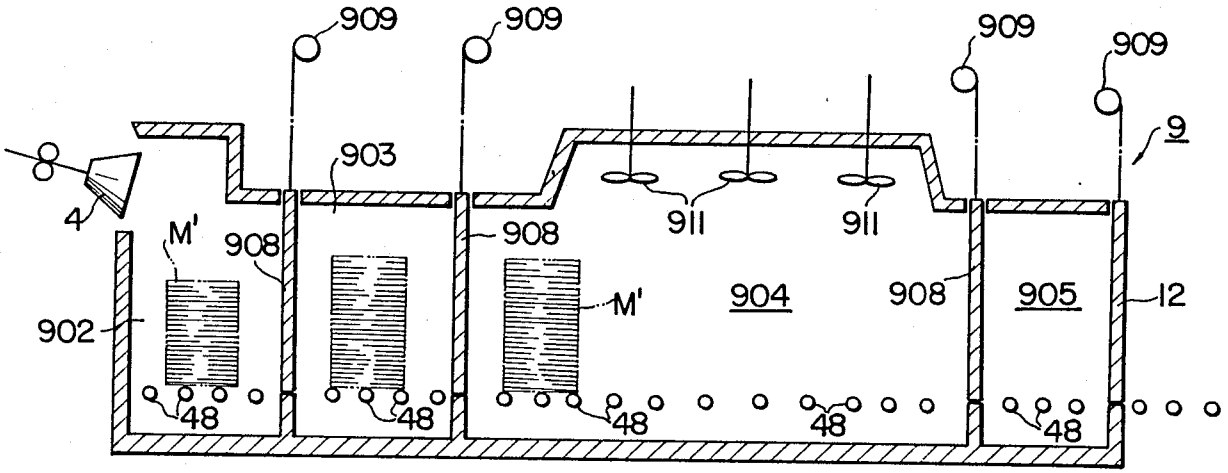

As illustrated in FIG. 10, if the heat-holding furnace is divided (preferably air tightly) into a coiling portion and a heat-holding portion by means of a descendable/ascendable door, it is possible to maintain the temperature control and the atmosphere state at a high accuracy level.

A heat-holding furnace 9 is comprised of, for instance, a succession of a coiling portion 902, an inlet side in-furnace controlling portion 903, a heat-holding portion 904 and an outlet side in-furnace controlling portion 905, as viewed from the inlet side. These portions 902 to 905 are provided with delivery rollers 8 for successive delivery of coils M' coiled at the coiling portion 902.

Doors 908 are interposed between the coiling portion 902 and the controoling portion 903; the controlling portion 903 and the heat-holding portion 904; and heat-holding portion 904 and the controlling portion 905, and are of the structure that they are ascendable and descendable by winches 909, etc. When these doors 908 are at the lowermost positions, the heat-holding furnace is tightly divided into the respective portions.

Reference numeral 4 stands for, e.g., a laying type coiler of the horizontal type. A wire rod after finish-rolling is formed into a coil M' by the coiler 4 and the coiling portion 902. Thus, a portion of the coiler 4 facing the coiling portion is of the heat-resistant structure, or is subjected to a heat resistant treatment, since it is exposed to a high-temperature atmosphere.

It is to be noted that reference numeral 911 indicates a stirring fan for making the in-furnace atmosphere uniform, and 12 stands for an outlet door mounted at the outlet of the heat-holding furnace. It goes without saying that, although not illustrated, a radiant tube and the like may be arranged to maintain the holding temperature.

Reference will now be made to the operation procedures.

(1) An as-finish-rolled wire rod is guided to the coiler 4, and coiled within the coiling portion 902. At this time, the respective doors 908 are located at the lowermost positions, so that the heat-holding furnace 9 is tightly divided into the respective portions.

(2) Upon completion of coiling, the door 908 between the coiling portion 902 and the inlet side controlling portion 903 is moved up to feed the coil M' into the inlet side controlling portion 903. Upon completion of such feeding, the door 908 is moved down to make partition between the coiling portion 902 and the inlet side controlling portion 903.

(3) Upon completion of the operation (2), the operation (1) takes place in the coiling portion 902. On the other hand, the atmosphere within the inlet side controlling portion 903 is controlled to the same atmosphere as in the heat-holding furnace 904. Thereafter, the door 908 between the controlling portion 903 and the heat-holding portion 908 is moved up to feed the coil M' into the heat-holding furnace 904. Following completion of such feeding, the door 908 is moved down.

(4) After the predetermined heat-holding has been completed within the heat-holding portion 904, the door 908 between the heat-holding portion 904 and the outlet side controlling portion 905 is moved up to feed the coil M' into the controlling portion 905. Upon completion of such feeding, the door 908 is moved down, followed by ascending movement of the outlet door 12 to discharge the coil M' from the heat-holding furnace 9.

The foregoing operations are repeated.

Figure 11:
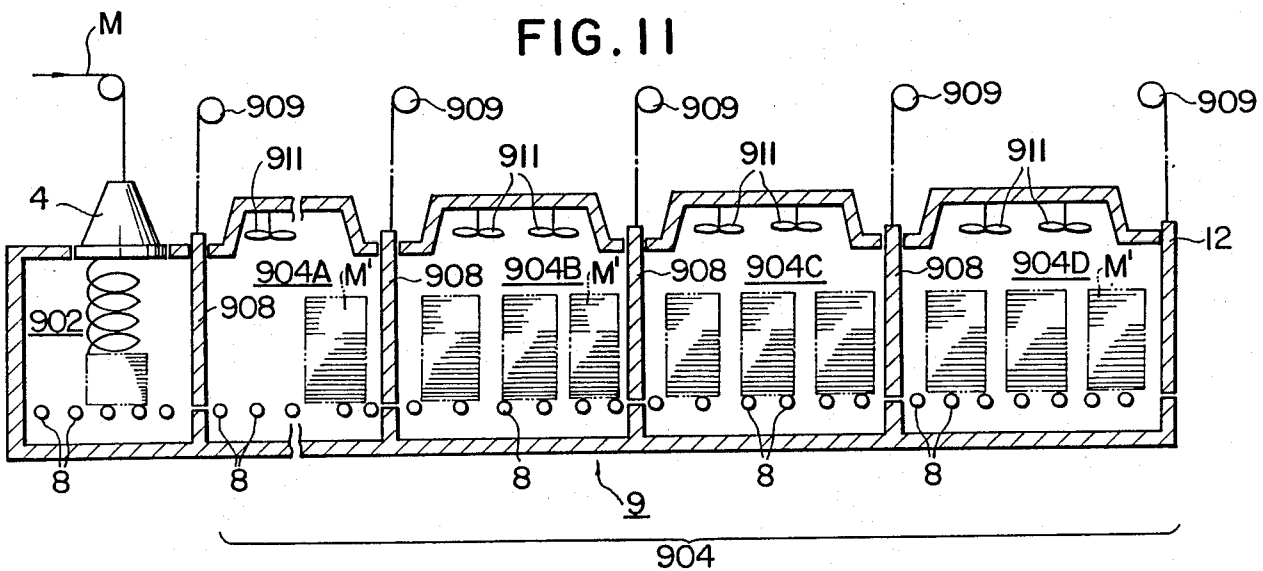

As illustrated in FIG. 11, if the heat-holding portion of the heat-holding furnace is divided into a plurality of sub-portions by means of a plurality of openable doors, it is then possible to establish the heat patterns corresponding to wire rod material in the respective sub-portions. The heat-holding portion 904 is provided therein with doors at suitable positions, said doors being capable of descending and ascending by winches 909, etc. When these doors 908 are located at the lowermost positions, they are tightly divided into a plurality of portions 904A to 904D. These portions are suitably provided with stirring fans 911 or radiant tubes (not shown), etc. to optimize the temperature control and the atmosphere state.

What is claimed is:

1. An apparatus for the direct softening heat treatment of rolled steel wire rods having an $Ar_1$ transformation point, comprising:

an annealing furnace for conducting the $Ar_1$ transformation of the wire rods;

a coiler disposed at the end of a rolling line of the wire rods so as to directly receive said rolled wire rods, said coiler being externally built of said annealing furnace within a closed chamber attached to the furnace at the entrance thereof; and means for maintaining said rolled wire rods above the $Ar_1$ transformation point during the coiling.

2. An apparatus as defined in claim 1, further comprising means for communicatably separating said closed chamber from said annealing furnace.

3. An apparatus as defined in claim 1, wherein said pot furnaces are disposed so as to be successively delivered upon completion of coiling in one of said pot furnaces.

4. An apparatus as defined in claim 1, wherein said coiler is a pouring type coiler, and said annealing furnace is a continuous furnace, said pouring type coiler being disposed within a closed chamber attached to said continuous furnace.

5. An apparatus as defined in claim 4, wherein said closed chamber of coiler is attached to the bottom portion of said continuous furnace.

6. The apparatus of claim 1, further comprising means for maintaining said rolled wire rods substantially free of ambient air during the coiling.

7. An apparatus for the direct softening heat treatment of rolled steel wire rods having an $Ar_1$ transformation point, comprising:

an annealing furnace for conducting $Ar_1$ transformation of the wire rods;

a coiler disposed at the end of a rolling line of the wire rods so as to directly receive said rolled wire rods, said coiler being disposed within a closed portion in said annealing furnace at the entrance thereof; and means for maintaining said rolled wire rods above the $Ar_1$ transformation point during the coiling.

8. The apparatus of claim 7, further comprising means for maintaining said rolled wire rods substantially free of ambient air during the coiling.

9. An apparatus as defined in claim 8, wherein said apparatus further comprises means for communicatably separating said closed portion from the remaining portion of said annealing portion.

10. An apparatus as defined in claim 9, wherein said annealing portion includes an output provided with a double door mechanism.

11. An apparatus as defined in claim 9, wherein said annealing portion is tightly partitioned into a plurality of sub-portions by means of openable doors.

12. An apparatus as defined in claim 9, wherein said annealing portion is provided with at least one stirring fan.

13. An apparatus as defined in claim 9, wherein said annealing portion is provided with means for maintaining or controlling the temperature.

14. An apparatus for the direct softening heat treatment of rolled steel wire rods having an $Ar_1$ transformation point, comprising:

a plurality of annealing pot furnaces for conducting $Ar_1$ transformation of the wire rods;

a coiler disposed within at least one of said pot furnaces at the end of a rolling line of the wire rods so as to directly receive said rolled wire rods;

means for maintaining the inside of said pot furnace substantially free of ambient air; and means for maintaining said rolled wire rods above the $Ar_1$ transformation point during the coiling.

15. An apparatus as defined in claim 14, wherein said coiler is a laying type coiler.

16. The apparatus of claim 14, wherein said means for maintaining the inside of said pot furnace substantially free of ambient air does so during the coiling and annealing.

17. An apparatus as defined in one of claims 1–14, wherein said coiler is of the laying type.

18. An apparatus as defined in one of claims 1–14, wherein said coiler is of the pouring type.

19. An apparatus as defined in one of claims 1–14, wherein said coiler is a laying type coiler and said annealing furnace is a continuous furnace.

20. An apparatus as defined in claim 19, wherein said laying type coiler includes a laying cone having a blade at a position where the blade does not interfere with the wire rod guided out and produces a uniform atmosphere temperature in the wire rod coiler.

21. An apparatus as defined in claim 20, wherein said laying cone is mounted on a ceiling wall of said furnace air tightly therewith.

22. An apparatus as defined in claim 21, wherein said laying type coiler includes a rider-holding mechanism for holding a rider at a position below said laying cone, a mechanism for moving up and down said rider-holding mechanism, a temporary supporting mechanism interposed between said ride-holding mechanism and said laying cone for temporarily supporting a wire rod just after finish-rolling and gradually descending as the coiling proceeds, which is guided along said laying cone, and rollers for feeding the coiled wire rod into said furnace.

23. An apparatus as defined in claim 22, wherein said laying type coiler includes a suitable number of guides which are descendable in operative association with said rider-holding mechanism and are ascendable individually, and are provided between said laying cone and said rider-holding mechanism and on the same circumference that has a given diameter and is coaxial with respect to said laying cone.

24. An apparatus as defined in claim 22, wherein the apparatus further includes a pre-heating furnace to preheat said rider.

25. An apparatus as defined in claim 24, wherein said pre-heating furnace is partitioned from said furnace by an operable door for insertion of said rider.

26. An apparatus as defined in claim 25, wherein said door for insertion of said rider is descendable and ascendable.

* * * * *